US009085151B2

(12) United States Patent
Iriguchi

(10) Patent No.: US 9,085,151 B2
(45) Date of Patent: Jul. 21, 2015

(54) LIQUID DROPLET DISCHARGE APPARATUS AND LIQUID DROPLET DISCHARGE ADJUSTING METHOD THEREOF

(71) Applicant: Akira Iriguchi, Aichi (JP)

(72) Inventor: Akira Iriguchi, Aichi (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 13/624,396

(22) Filed: Sep. 21, 2012

(65) Prior Publication Data

US 2013/0222454 A1 Aug. 29, 2013

(30) Foreign Application Priority Data

Feb. 29, 2012 (JP) ..... 2012-044363

(51) Int. Cl.

| | |
|---|---|
| ***B41J 2/145*** | (2006.01) |
| ***B41J 2/155*** | (2006.01) |
| ***B41J 2/21*** | (2006.01) |
| *B41J 2/14* | (2006.01) |

(52) U.S. Cl.

CPC ..... *B41J 2/155* (2013.01); *B41J 2/2125* (2013.01); *B41J 2/2146* (2013.01); *B41J 2002/14475* (2013.01); *B41J 2202/20* (2013.01)

(58) Field of Classification Search

USPC ..... 347/1, 3, 12–13, 40–43

See application file for complete search history.

(56) References Cited

U.S. PATENT DOCUMENTS

| | | | | |
|---|---|---|---|---|
| 5,384,587 | A * | 1/1995 | Takagi et al. | 347/41 |
| 6,846,064 | B2 * | 1/2005 | Yamane | 347/40 |
| 2004/0021730 | A1 | 2/2004 | Yamane | |
| 2007/0242098 | A1 * | 10/2007 | Sudo et al. | 347/40 |
| 2010/0231644 | A1 | 9/2010 | Otokita | |

FOREIGN PATENT DOCUMENTS

| | | | |
|---|---|---|---|
| JP | 2003-305853 | A | 10/2003 |
| JP | 2010-208120 | A | 9/2010 |
| JP | 2010-208121 | A | 9/2010 |

* cited by examiner

*Primary Examiner* — Lam Nguyen

(74) *Attorney, Agent, or Firm* — Scully, Scott, Murphy & Presser, P.C.

(57) ABSTRACT

A liquid droplet discharge apparatus includes a liquid droplet discharge head and a control unit. The liquid droplet discharge head includes: a plurality of main nozzles arranged in a first direction and discharging liquid droplets of main dots; and a plurality of sub nozzles arranged at end portion sides of arrays of the main nozzles and discharging liquid droplets of sub dots. The control unit is configured to control the liquid droplet discharge head to discharge the liquid droplets from the main and sub nozzles and to form sub dot arrays by the liquid droplets discharged from the sub nozzles in two arrays with being staggered at a predetermined interval in the second direction between main dot arrays by the liquid droplets discharged from the main nozzles, so as to form the dot arrays.

9 Claims, 7 Drawing Sheets

LIQUID DROPLET DISCHARGE APPARATUS AND LIQUID DROPLET DISCHARGE ADJUSTING METHOD THEREOF

CROSS-REFERENCE TO RELATED APPLICATIONS

This application claims priority from Japanese Patent Application No. 2012-044363 filed on Feb. 29, 2012, the entire subject matter of which is incorporated herein by reference.

TECHNICAL FIELD

The invention relates to a liquid droplet discharge apparatus such as line printer (e.g., inkjet printer) of an inkjet recording type and a liquid droplet discharge adjusting method thereof.

BACKGROUND

As a liquid droplet discharge apparatus, there have been known an inkjet printer having a recording head in which a plurality of nozzles discharging liquid droplets of ink is arranged in a nozzle array. While reciprocating the recording head in a main scanning direction, the printer discharges the liquid droplets of ink to a recording medium moving in a sub-scanning, so as to perform a recording operation. In the printer, a plurality of lines is recorded by scanning of one time. That is, the recording is performed in a recording area corresponding to a width of the nozzle array every main scanning.

When recording a deep color image on a recording medium on which ink easily blurs, such as normal sheet, the blur is conspicuous at a dry edge of the recording area, around which the ink is not colored. The blur overlaps at a boundary part of the two recording areas, so that a black line may occur.

The occurrence of the black line can be prevented by adjusting an amount of relative movement of the recording head and the recording medium in the sub-scanning direction. That is, an interval between the recording areas is increased every main scanning, so that it is possible to prevent the overlapping of the blur and to prevent the black line from occurring. However, when a light color image is recorded at the adjusted state, an amount of the ink is small, so that the blur is also small and a white line is generated between the recording areas.

If an amount of the movement of the sub-scanning every recording area were adjusted, in correspondence to an image to be recorded, it could be possible to prevent the black line or white line. However, the control thereof is complicated.

Thus, there have been proposed a technology in which a liquid droplet discharge head having a nozzle array having a plurality of large nozzles arranged at a central part and a nozzle array having a plurality of small nozzles arranged at an end portion is used. According to this related-art technology, when discharging liquid droplets, the small nozzles discharge the liquid droplets at a boundary part of the recording area by the large nozzles, so that the occurrence of the line at the boundary part may be reduced.

SUMMARY

Illustrative aspects of the invention provide a liquid droplet discharge apparatus and a liquid droplet discharge adjusting method thereof with which a line (black line, white line), which is generated in performing a recording operation on a recording medium, is made not to be conspicuous.

According to one illustrative aspect of the invention, there is provided a liquid droplet discharge apparatus comprising: a liquid droplet discharge head comprising a plurality of nozzles arranged in a plurality of arrays along a first direction; and a control unit configured to control the liquid droplet discharge head to discharge liquid droplets from the plurality of nozzles toward a recording medium while relatively moving the recording medium and the liquid droplet discharge head in a second direction orthogonal to the first direction, and form a plurality of dot arrays in the second direction, the dots of the array being arranged in the first direction, so as to form an image on the recording medium. The plurality of nozzles comprises: a plurality of main nozzles that is arranged in the first direction and is configured to discharge liquid droplets of main dots having a first diameter, and a plurality of sub nozzles that is arranged at end portion sides of arrays of the main nozzles and is configured to discharge liquid droplets of sub dots having a second diameter that is smaller than the first diameter. The control unit is configured to control the liquid droplet discharge head to form sub dot arrays by the liquid droplets discharged from the sub nozzles in two arrays with being staggered at a predetermined interval in the second direction between main dot arrays by the liquid droplets discharged from the main nozzles, so as to form the dot arrays.

BRIEF DESCRIPTION OF THE DRAWINGS

FIGS. 5A and 5B show another exemplary embodiment, in which FIG. 5A illustrates a relation of main nozzles and sub-nozzles of two adjacent recording heads, and FIG. 5B illustrates a relation of main dot arrays and sub dot arrays recorded on a recording sheet;

FIGS. 6A and 6B show still another exemplary embodiment, in which FIG. 6A illustrates a relation of main nozzles and sub-nozzles of two adjacent recording heads, and FIG. 6B illustrates a relation of main dot arrays and sub dot arrays recorded on a recording sheet;

FIGS. 7A and 7B show still another exemplary embodiment, in which FIG. 7A illustrates a relation of main nozzles and sub-nozzles of two adjacent recording heads, and FIG. 5B illustrates a relation of main dot arrays and sub dot arrays recorded on a recording sheet;

DETAILED DESCRIPTION

<General Overview>

Figure 1:
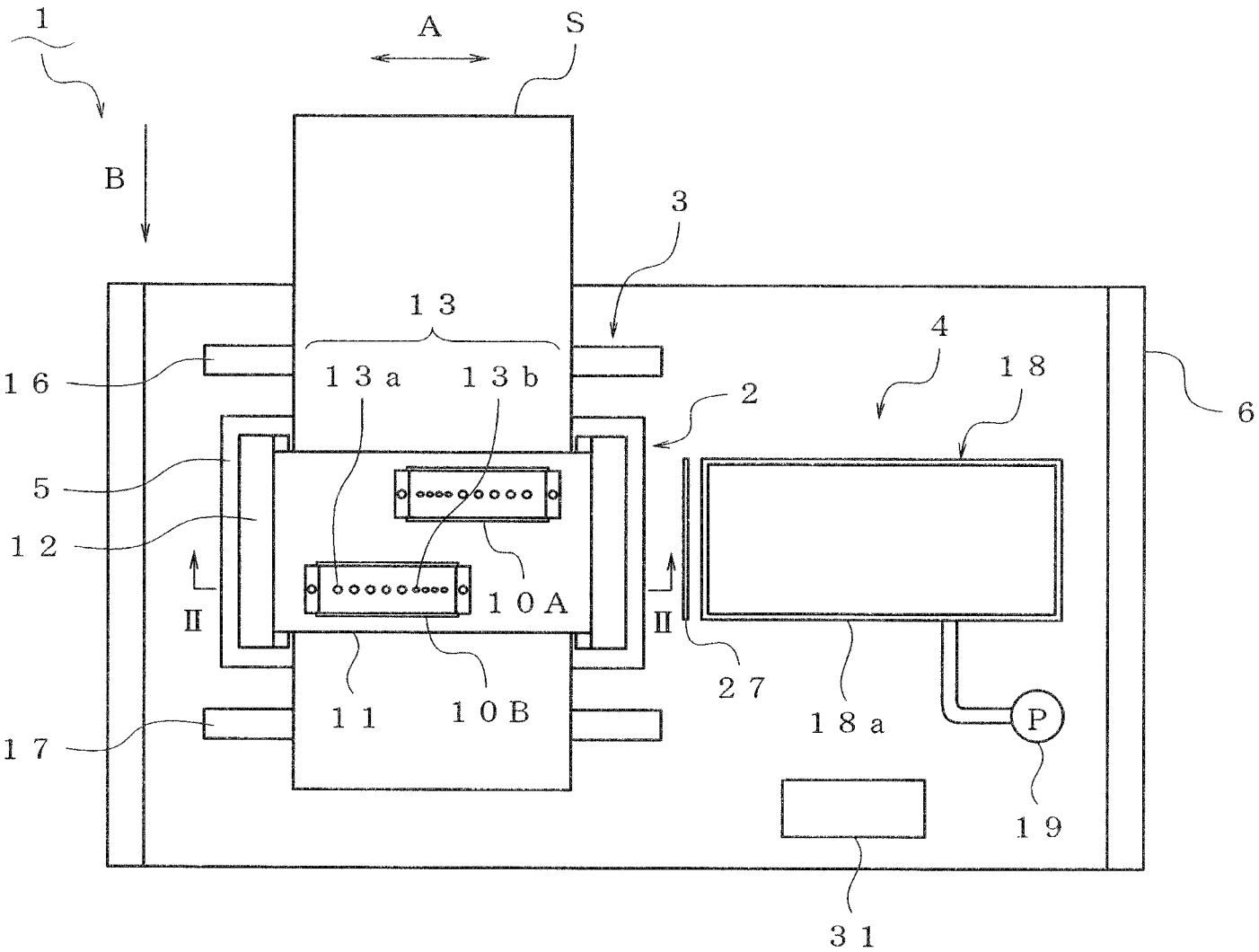
FIG. 1 is a plan view of a line printer according to an exemplary embodiment of the invention.

According to the above-described related-art technology, the sub-scanning is performed such that a recording position (liquid droplet discharge position) on the recording medium by the small nozzles is deviated in an array direction of the nozzle array from a period of an ink discharge position on the recording medium by the large nozzles in a previous main scanning or next main scanning. Due to this, it is difficult to perform the minute adjustment corresponding to each printer.

Further, there have been proposed a line printer in which a plurality of recording heads is arranged in parallel. In this printer, end nozzles of respective units are adjacent to each other at a boundary between the adjacent heads. Thus, when a pitch between the end nozzles of the units being laid over deviates from a preset nozzle pitch, a white line or black line may be generated in performing the recording operation on the recording medium, like the above serial type.

Therefore, illustrative aspects of the invention provide a liquid droplet discharge apparatus and a liquid droplet discharge adjusting method thereof with which a line (black line, white line), which is generated in performing a recording operation on a recording medium, is made not to be conspicuous.

According to a first illustrative aspect of the invention, there is provided a liquid droplet discharge apparatus comprising: a liquid droplet discharge head comprising a plurality of nozzles arranged in a plurality of arrays along a first direction; and a control unit configured to control the liquid droplet discharge head to discharge liquid droplets from the plurality of nozzles toward a recording medium while relatively moving the recording medium and the liquid droplet discharge head in a second direction orthogonal to the first direction, and form a plurality of dot arrays in the second direction, the dots of the array being arranged in the first direction, so as to form an image on the recording medium. The plurality of nozzles comprises: a plurality of main nozzles that is arranged in the first direction and is configured to discharge liquid droplets of main dots having a first diameter, and a plurality of sub nozzles that is arranged at end portion sides of arrays of the main nozzles and is configured to discharge liquid droplets of sub dots having a second diameter that is smaller than the first diameter. The control unit is configured to control the liquid droplet discharge head to form sub dot arrays by the liquid droplets discharged from the sub nozzles in two arrays with being staggered at a predetermined interval in the second direction between main dot arrays by the liquid droplets discharged from the main nozzles, so as to form the dot arrays.

According to the above configuration, based on the image data, the control unit forms the sub dot arrays formed by the sub nozzles in two arrays with being staggered at a predetermined interval in the second direction between the main dot arrays formed by the main nozzles. According thereto, a so-called white line or black line is prevented from occurring at a part (boundary part) between recording areas of the main dot arrays by the two sub dot arrays of the liquid droplets discharged from the sub nozzles. As a result, it is possible to improve a quality of an image to be formed on the recording medium.

According to a second illustrative aspect of the invention, the control unit comprises a deviation amount change unit configured to change discharge timing of the sub nozzles so as to change the predetermined interval.

According to the above configuration, the discharge timing of the sub nozzles is changed by the control unit, so that the predetermined interval is simply changed. Therefore, it is possible to easily adjust the interval that is optimal for avoiding the occurrence of the so-called white line or black line.

According to a third illustrative aspect of the invention, a sub nozzle array by the plurality of sub nozzles is formed at a position deviating in the second direction from a main nozzle array by the plurality of main nozzles.

According to the above configuration, the sub nozzle array is beforehand formed at a position deviating in the second direction from the main nozzle array. Therefore, the sub dot arrays are formed in two arrays with being staggered at the interval in the second direction between the main dot arrays even without changing the discharge timing.

According to a fourth illustrative aspect of the invention, the liquid droplet discharge apparatus further comprises a plurality of liquid droplet discharge heads arranged in parallel. The liquid droplet discharge heads adjacent to each other are staggered in the second direction and the sub nozzles of the liquid droplet discharge heads adjacent to each other are arranged to overlap in the first direction.

According to the above configuration, even when a plurality of liquid droplet discharge heads is provided, the so-called white line or black line is prevented from occurring at the boundary part between the recording areas to be recorded by the respective heads. As a result, it is possible to improve a quality of an image to be formed on the recording medium.

According to a fifth illustrative aspect of the invention, the liquid droplet discharge apparatus is a serial printer. The liquid droplet discharge head is configured such that: sub nozzle arrays by the plurality of sub nozzles are arranged at both ends of a main nozzle array by the plurality of main nozzles; and the sub nozzle arrays arranged at both ends of the main nozzle array are staggered in opposite directions with respect to the main nozzle array.

According to the above configuration, also in the serial printer, the sub dot arrays are formed in two arrays with being staggered at a predetermined interval in the second direction. According thereto, the so-called white line or black line is prevented from occurring, so that it is possible to improve a quality of an image to be formed on the recording medium.

According to a sixth illustrative aspect of the invention, the plurality of sub nozzles is configured such that a nozzle pitch thereof in the first direction is smaller than that of the plurality of main nozzles.

According to a seventh illustrative aspect of the invention, the plurality of sub nozzles is configured such that a nozzle pitch thereof in the first direction is irregular.

According to the above configuration, by adjusting the discharge timing or discharge amount of the sub nozzles, it is possible to finely set the predetermined interval of the sub dot arrays over a wide range.

According to an eighth illustrative aspect of the invention, there is provided A liquid droplet discharge adjusting method using the liquid droplet discharge apparatus, the method comprising: comparing shadings of an image formed by a main dot array of liquid droplets discharged from the plurality of main nozzles and an image formed by a sub dot array of liquid droplets discharged from the plurality of sub nozzles; and adjusting the predetermined interval to match the shadings.

Here, the shadings are evaluated by the well-known technique, for example by seeing the same with eyes or by reading a printed sample with a scanner and measuring a density thereof.

According to the above configuration, it is possible to manufacture the liquid droplet discharge apparatus capable of preventing the so-called white line or black line from occurring and improving a quality of an image to be formed on the recording medium.

According to the illustrative aspects of the invention, as described above, the sub dot arrays are formed in two arrays with being staggered at a predetermined interval in the second direction between the main dot arrays. Thus, the so-called white line or black line is prevented from occurring at the part (boundary part) between the recording areas of the main dot arrays by the two sub dot arrays. As a result, it is possible to improve a quality of an image to be formed on the recording medium.

Exemplary Embodiments

Hereinafter, exemplary embodiments of the invention will be described with reference to the accompanying drawings.

Figure 2:
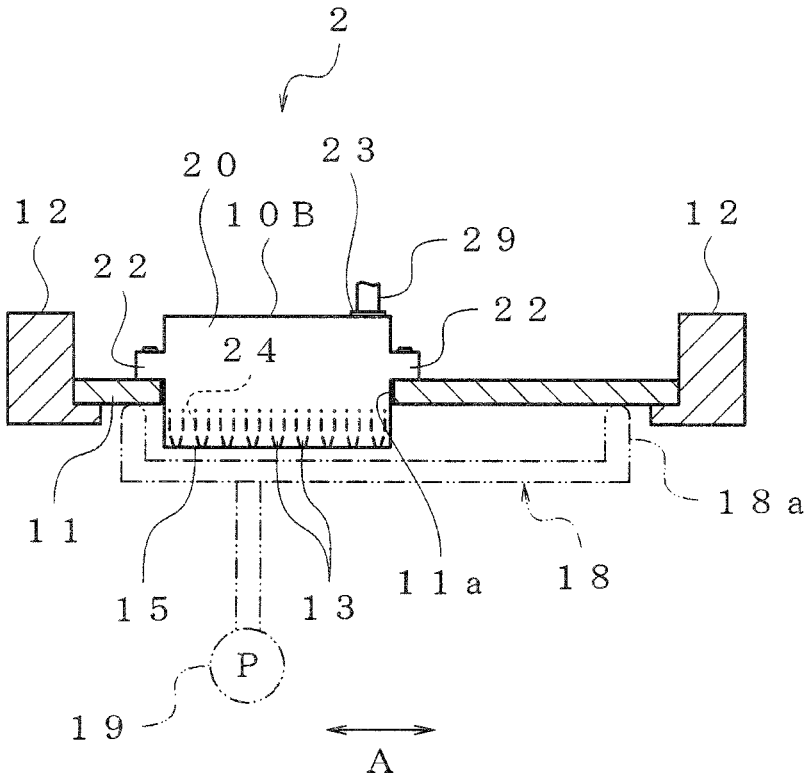
FIG. 2 is a sectional view taken along a line II-II of FIG. 1, in which a recording head is omitted.

As shown in FIGS. 1 and 2, a line printer 1 (one example of a liquid droplet discharge apparatus) of an inkjet recording type includes a head unit 2 having two recording heads 10A, 10B (one example of a liquid droplet discharge head) configured to discharge liquid droplets of ink, a conveyance mechanism 3 configured to convey a recording sheet S (one example of a recording medium) relative to the head unit 2, a maintenance unit 4 configured to maintain or restore (hereinafter, referred to as 'maintenance') liquid droplet discharge performance of the recording heads 10A, 10B and a control device 31.

The head unit 2 is arranged above (e.g., the sheet front of FIG. 1) a horizontally mounted platen 5 when recording an image on the recording sheet S. The head unit 2 includes the two recording heads 10A, 10B each of which having a plurality of nozzles 13 arranged in a plurality of arrays along a first direction A (e.g., left-right direction in FIG. 1) and a head holding member 11 configured to hold the two recording heads 10A, 10B. Incidentally, the two recording heads 10A, 10B are arranged in the same horizontal surface so that they are staggered in a second direction B (e.g., upper-lower direction in FIG. 1) perpendicular to the first direction with an opening surface of a liquid droplet discharge surface 15 (nozzles 13) being directed downward.

Figure 4A:
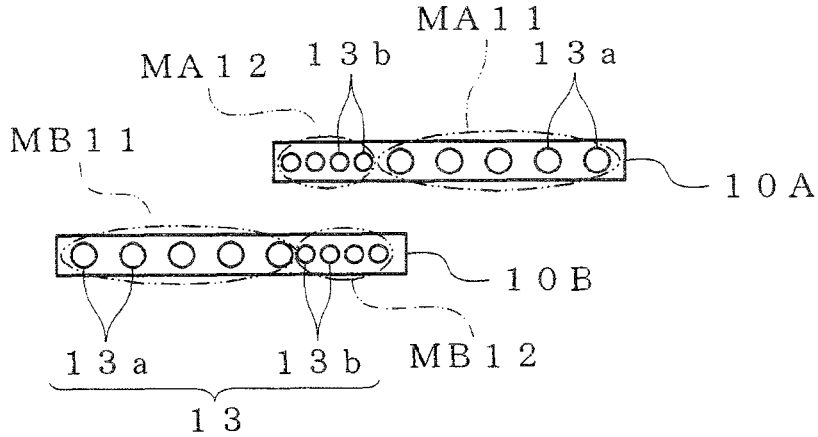
FIG. 4A illustrates a relation of main nozzles and sub-nozzles of two adjacent recording heads.
Figure 4B:
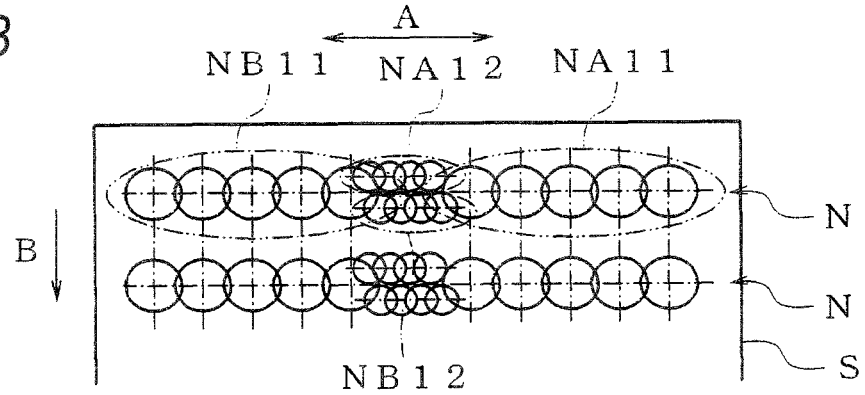
FIGS. 4B to 4D illustrate a relation of main dot arrays and sub dot arrays recorded on a recording sheet.

In the respective recording heads 10A, 10B, as shown in FIG. 4A, the plurality of nozzles 13 is arranged in an array shape along the first direction A. The nozzles 13 (13*a*, 13*b*) are opened downward (e.g., toward an inner side of the sheet of FIG. 1) and are configured to discharge liquid droplets of ink toward the recording sheet S on the platen 5. The nozzles 13 includes a plurality of main nozzles 13*a* (main nozzle arrays MA11, MB11) and a plurality of sub nozzles 13*b* (sub nozzle arrays MA12, MB12). The plurality of main nozzles 13*a* (main nozzle arrays MA11, MB11) is arranged in an array shape along the first direction A and is configured to discharge liquid droplets of main dots having a large diameter. The plurality of sub nozzles 13*b* (sub nozzle arrays MA12, MB12) is arranged at end sides of the arrays of the main nozzles 13*a* (main nozzle arrays MA11, MB11) in the first direction A and is configured to discharge liquid droplets of sub dots having a small diameter.

Each of the recording heads 10A, 10B has a flow path unit 20 that configures a liquid flow path communicating with the plurality of nozzles 13. A lower surface of the flow path unit 20 is a liquid droplet injection surface 15 having the plurality of nozzles 13 opened.

The flow path unit 20 has a substantially rectangular parallelepiped outward shape. The flow path unit 20 is provided at both end portions in the first direction A with two fixing parts 22 for fixing the flow path unit 20 to the head holding member 11 so that they protrude from side surfaces of the flow path unit 20. An upper surface of the flow path unit 20 is provided with an ink supply part 23 that is connected to an ink cartridge (not shown) by a tube 29 (refer to FIG. 2). Further, the flow path unit 20 is formed therein with an ink flow path 24 for supplying ink, which is supplied from the ink supply part 23, to each of the nozzles 13. More specifically, as the ink flow path 24, a plurality of individual flow paths communicating with the respective nozzles 13 and a common ink chamber distributing the ink to the individual flow paths are formed. Further, flow path ends of the individual flow paths are opened on a lower surface of the flow path unit 20. Incidentally, although not shown, the flow path unit 20 is provided with an actuator (for example, piezoelectric actuator) that applies a discharge pressure to the ink in the individual flow paths corresponding to the respective nozzles 13, as a part of the respective recording heads 10A, 10B.

The head holding member 11 is configured to hold the recording heads 10A, 10B is a plate-shaped member. The head holding member 11 is connected to a frame member 12 at both end portions in the first direction A. The frame member 12 is fixed to a housing 6 of the printer 1. The head holding member 11 is formed with mounting holes 11*a* corresponding to the respective recording heads 10A, 10B. At a state where the flow path units 20 of the recording heads 10A, 10B are respectively inserted into the mounting holes 11*a*, each of the flow path units 20 is fixed to the head holding member 11 at the two fixing parts 22 protruding from the side surfaces thereof by screws and the like.

A lower end portion of the flow path unit 20 protrudes more downward from the head holding member 11 through the mounting hole 11*a* of the head holding member 11. An edge of the head holding member 11 is fixed to the frame member 12. Incidentally, the respective recording heads 10A, 10B are supplied with the ink from the ink cartridge (not shown) mounted to the housing 6 of the printer 1 through the tube 29.

The conveyance mechanism 3 includes a supply roller 16 and a discharge roller 17, which are disposed to position the head unit 2 backward and forward, and are configured to move the recording sheet S along the platen 5 in the second direction B relative to the head unit 2 by the two rollers 16, 17.

The printer 1 is configured to discharge the liquid droplets of ink toward the recording sheet S from the nozzles 13 of the two recording heads 10A, 10B while moving the recording sheet S in the second direction B by the rollers 16, 17 of the conveyance mechanism 3. According thereto, a plurality of dot arrays N, the dots of the array being arranged along the first direction A, is formed in the second direction B, so that a desired image is formed on the recording sheet S.

The printer 1 includes a maintenance unit 4 configured to perform maintenance on the head unit 2 and a wiper 27. The maintenance unit 4 is positioned at the right side of the platen 5 when the maintenance is not performed. On the other hand, when performing the maintenance, the maintenance unit 4 is moved to a position facing the head unit 2 by a position switching mechanism (not shown).

The maintenance unit 4 has a cap member 18 made of an elastic member such as rubber, a suction pump 19 connected to the cap member 18 and the wiper 27 configured to wipe off the ink attached on the liquid droplet discharge surfaces 15 of the recording heads 10A, 10B. The cap member 18 is moved upward and downward by a cap elevating mechanism (not shown) having a driving source such as motor and a power transfer member such as gear. When the cap member 18 is pressed to the head unit 2 and a lip part 18*a* of an outer periphery thereof is closely adhered at a state where the head unit 2 is positioned at the maintenance position, the cap member covers the liquid droplet discharge surfaces 15 of the recording heads 10A, 10B at a time. The suction pump 19 performs a so-called suction purge operation of depressurizing the inside of the cap member 18 at a state where the cap member 18 covers the liquid droplet discharge surfaces 15 of the recording heads 10A, 10B so as to forcibly discharge the ink from the respective nozzles 13 of the two recording heads 10A, 10B.

The wiper 27 is made of an elastic member such as rubber. The wiper 27 is configured to move relative to the head unit 2 at a state where a tip thereof is closely adhered to the liquid droplet discharge surfaces 15 of the recording heads 10A, 10B, so as to wipe off the ink attached on the liquid droplet discharge surfaces 15 after the suction purge has been performed. Incidentally, when performing the maintenance, the head unit 2 may be moved relative to the maintenance unit 4, so that both may face each other.

Figure 3A:
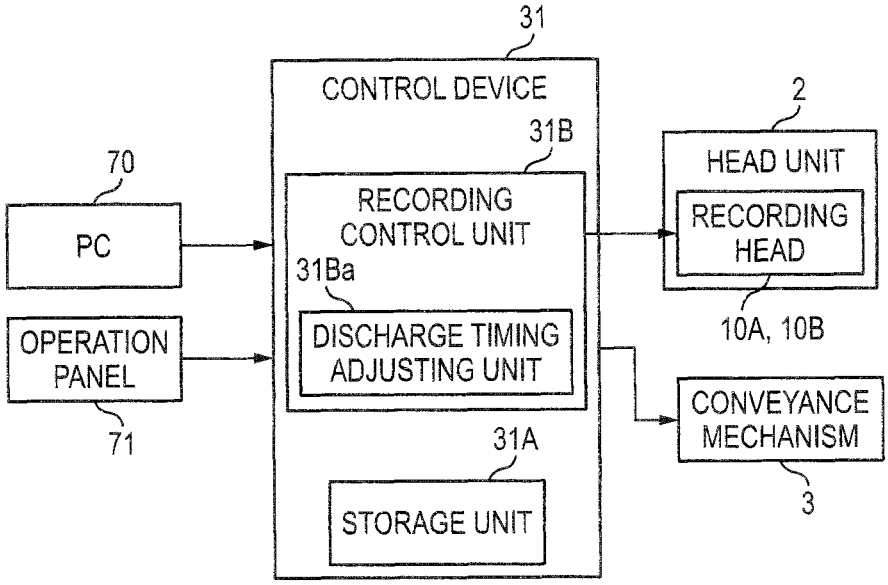
FIGS. 3A and 3B are block diagrams schematically showing an electrical configuration of the printer.

In the below, an electrical configuration of the printer 1 will be described on the basis of the control device 31 of the printer 1. The control device 31 of the printer 1 shown in FIG. 3A has a microcomputer including a CPU (abbreviation of Central Processing Unit), a ROM (abbreviation of Read Only Memory) in which a variety of programs and data for controlling an overall operation of the printer 1 are stored, a RAM (abbreviation of Random Access Memory) in which data to be processed by the CPU is temporarily stored, and the like, a variety of calculation circuits for controlling the respective configurations of the printer 1 and a storage unit 31A configured by a storage medium such as flash memory having various data stored therein.

The CPU is configured to execute the various programs stored in the ROM, so that the microcomputer and the calculation circuits operate as a recording control unit 31B (one example of a control unit). The storage unit 31A stores therein setting values and the like that are used in a variety of controls to be executed by the control device 31. The control device 31 is connected with a PC 70 that is an external apparatus and an operation panel 71 having a display, an operation button and the like. The recording control unit 31B is configured to control the recording heads 10A, 10B of the head unit 2 and the conveyance mechanism 3, based on image data and the like input from the PC 70.

The recording control unit 31B has a discharge timing adjusting unit 31Ba configured to adjust discharge timings of the respective nozzles 13. In the below, a case is described in which an inspector adjusts the discharge timings of the nozzles 13 by using the discharge timing adjusting unit 31Ba in a factory before the shipping. At a state where the manufacturing of the printer 1 is substantially completed, i.e., the discharge timings of the main nozzles 13*a* and the sub nozzles 13*b* are initialized, the inspector enables the nozzles 13 (13*a*, 13*b*) to actually discharge liquid droplets, so as to perform a recording operation on the recording sheet S. From the recording operation, the inspector compares and evaluates shadings of an image, which is formed by the main dot arrays of the liquid droplets discharged from the main nozzles 13*a*, and an image, which is formed by the sub dot arrays of the liquid droplets discharged from the sub nozzles 13*b*, by the well-known technique. It is necessary to compare and evaluate the shadings of the images formed by the liquid droplets discharged from the respective nozzles 13 in high precision. Therefore, it is preferable that the inspector should perform the evaluation with an equipment of the manufacturer before a user uses the printer, i.e., before the shipping.

Based on a result of the comparison and evaluation, the inspector re-sets the discharge timings of the sub nozzles 13*b* (e.g., an amount of deviation from the discharge timing of the main nozzles 13*a*) stored in the storage unit 31A for each sub nozzle array so that the shadings substantially coincide with each other. That is, for each sub nozzle array, the inspector re-records the discharge timings of the respective sub nozzles 13*b*, which are initially set for the recording heads 10A, 10B, with the discharge timings at which the shadings of the image by the main dot array (e.g., one array) and the image by the sub dot arrays (e.g., two arrays) substantially coincides with each other, by using the PC 70.

Figure 4C:
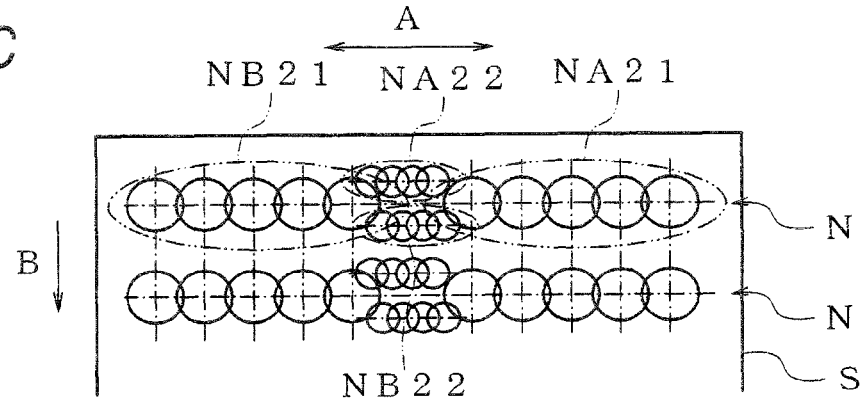

For example, when the discharge timings of the sub nozzles 13*b* arrays are set to highly deviate from the discharge timing of the main nozzle 13*a* array, an interval between the sub dot arrays NA22, NB22 in the second direction B is increased, as shown in FIG. 4C. By using this, the re-setting is made by the inspector and the discharge timings of the sub nozzles 13*b* are recorded for each array, as recording control information, in the storage unit 31A, together with the other recording-related information.

Therefore, when the user actually uses the printer (e.g., when recording an image and the like), the discharge timing adjusting unit 31Ba sets the discharge timing of the main nozzles 13*a* and the discharge timing of the sub nozzles 13*b*, which deviates by a predetermined time period from the discharge timing of the main nozzles 13*a*, with respect to the recording heads 10A, 10B, so that the shadings of the image formed by the main dot array and the image formed by the sub dot arrays substantially coincide with each other. As described above, the discharge timings are stored in the storage unit 31A as the recording control information. Whenever the recording data is input from the PC 70 to the control device 31 and an image and the like are recorded on the recording sheet S, the discharge timing adjusting unit 31Ba reads out the discharge timings from the recording control information stored in the storage unit 31A and performs a recording operation.

According thereto, the interval of the two sub dot arrays formed between the main dot arrays has a size with which a so-called white line or black line is invisible Therefore, the so-called white line or black line is prevented from occurring, so that it is possible to manufacture the line printer 1 capable of forming a high-quality image on the recording sheet S.

Here, as shown in FIG. 4A, the nozzles 13 of the respective recording heads 10A, 10B are formed so that the sub nozzle arrays MA12, MB12 do not deviate from the main nozzle arrays MA11, MB11. However, since the discharge timings of the main nozzles 13*a* and the sub nozzles 13*b* are beforehand stored in the storage unit 31A, as the recording control information, the sub dot arrays NA12, NB12 are formed in two arrays at an interval in the second direction B between the main dot arrays NA11, NB11 in one dot array N. Here, the interval of the sub dot arrays NA12, NB12 in the second direction B has a size with which the shadings of the image formed by the main dot arrays NA11, NB11 and the image formed by the sub dot arrays NA12, NB12 substantially coincide with each other. Therefore, a so-called white line or black line is prevented from occurring at a part (e.g., boundary part) between the recording areas by the main dot arrays NA11, NB11.

Figure 4D:
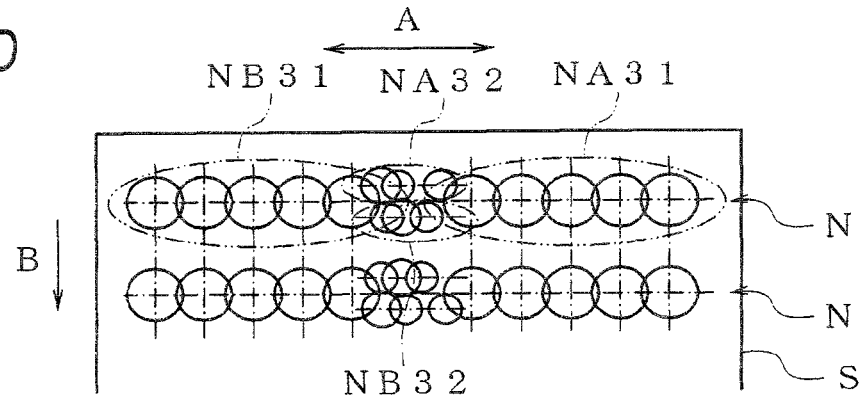

Further, as shown in FIG. 4D, in addition to the change of the discharge timing of the sub nozzles 13*b*, an amount of liquid droplets to be discharged from the sub nozzles 13*b* is changed, so as to change the interval of the sub dot arrays and the diameter of the sub dots. That is, it may be possible to preset the recording control information including the amount of liquid droplets in addition to the change of the discharge timing so that the line is not further conspicuous. Incidentally, NA21, NA31, NB21 and NB31 indicate the main dot arrays.

According to the printer 1, the recording control unit 31B controls the discharge timing of the sub nozzles 13*b* based on the recording control information so that the discharge timing of the sub nozzles 13*b* deviates by a predetermined time period from the discharge timing of the main nozzles 13*a* on the basis of the image data. Accordingly, the sub dot arrays NA12, NB12 are formed in two arrays at a predetermined interval in the second direction B between the main dot arrays NA11, NB11. The interval has a size with which the so-called white line or black line is not conspicuous owing to the two sub dot arrays at the part (e.g., boundary part) between the recording areas by the main dot areas.

The invention can be also implemented in various modified embodiments.

Figure 3B:
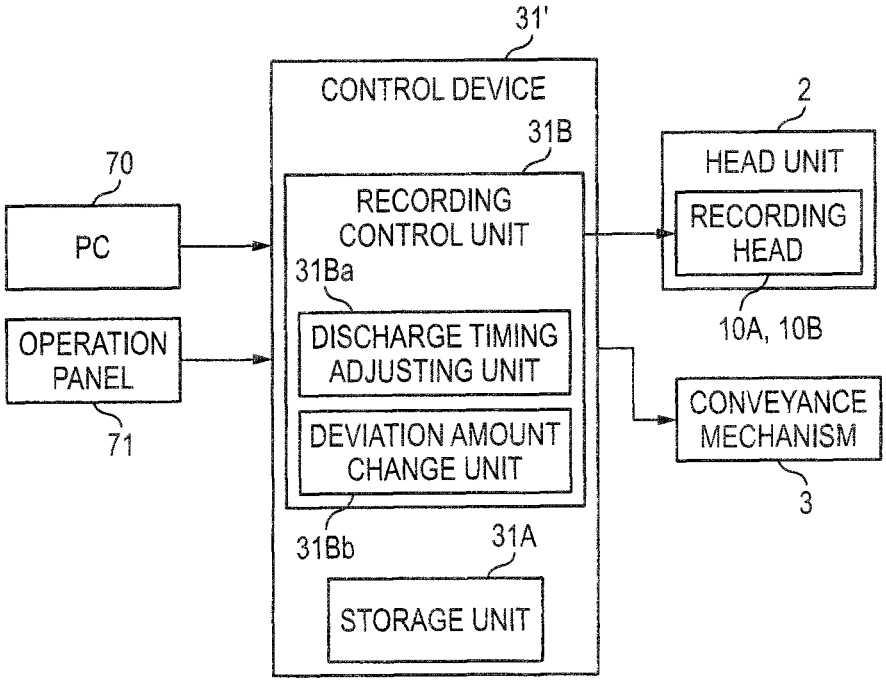

(i) As shown in FIG. 3B, the control device 31 may have a deviation amount change unit 31Bb configured to change the discharge timing of the sub nozzles so as to change the interval. In this case, the discharge timing of the sub nozzles 13*b*, which is a basis, and a plurality of discharge timings deviating from the discharge timing by a predetermined time period are beforehand stored in the storage unit 31A, as timing change information of the sub nozzles 13*b*. When the deviation amount change unit 31Bb receives a change instruction from the PC 70, the optimal discharge timing relating to the change instruction is selected from the timing change information (e.g., the plurality of discharge timings stored for the sub nozzles 13*b*) stored in the storage unit 31A. The recording control information about the preset discharge timing of the sub nozzles 13*b* is re-recorded with the selected separate discharge timing, so that the interval of the sub dot arrays to be formed on the recording sheet S is changed. In this manner, the deviation amount of the discharge timing of the sub nozzles 13*b* is changed by the deviation amount change unit 31Bb, so that it is possible to simply change the preset interval. By this change, it is possible to configure the optimal interval capable of preventing the so-called white line or black line from occurring.

Further, after reading out a test pattern by a scanner and seeing a density of the image, the deviation amount change unit 31Bb may be enabled by operating the operation panel 71 of the printer 1. Further, in addition to the timing change information about the discharge timings of the sub nozzles 13*b*, a plurality of amounts of liquid droplets to be discharged from the sub nozzles 13*b* may be pre-stored in the storage unit 31A as the liquid droplet change information so that the amount of liquid droplets can be also changed based on the above change instruction.

Figure 5A:
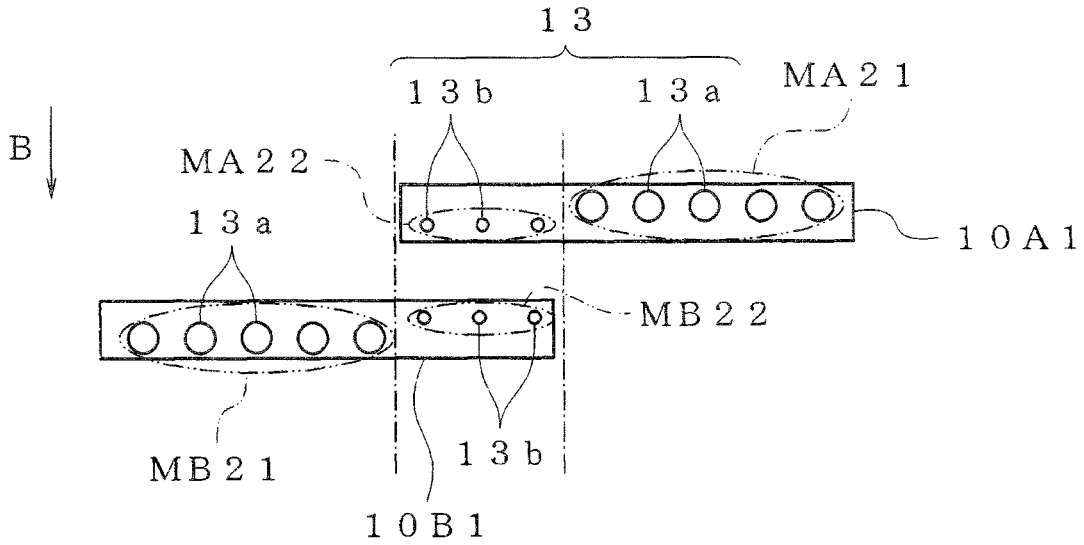
Figure 5B:
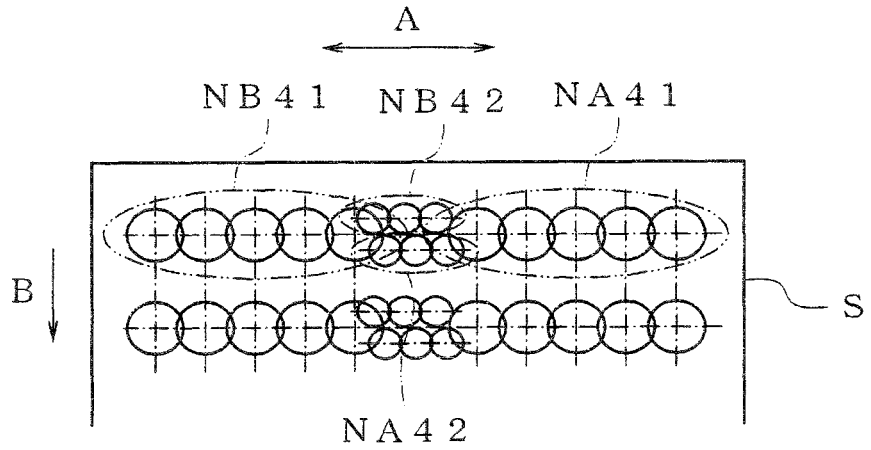

(ii) As shown in FIG. 5, the sub nozzle arrays MA22, MB22 may be formed in advance at positions deviating in the second direction B from the main nozzle arrays MA21, MB21 so that an interval of the two sub dot arrays NA42, NB42 has a size with which the above-described line is invisible. In this case, in the recording heads 10A1, 10B1 adjacent to each other, the sub nozzle arrays MA22, MB22 are positioned with being deviated toward the opposed directions in the second direction B from the main nozzle arrays MA21, MB21. For example, in the example shown in FIG. 5A, in the recording head 10A1, the sub nozzle array MA22 is deviated in a downstream side of the second direction B from the main nozzle array MA21, whereas in the recording head 10B1, the sub nozzle array MB22 is deviated in an upstream side of the second direction B from the main nozzle array MB21.

According thereto, it is possible to form the sub dot arrays NA42, NB42 in two arrays with being staggered at a predetermined interval in the second direction B between the main dot arrays NA41, NB41 even without changing the discharge timing of the sub nozzles 13*b* relative to the main nozzles 13*a*.

Figure 6A:
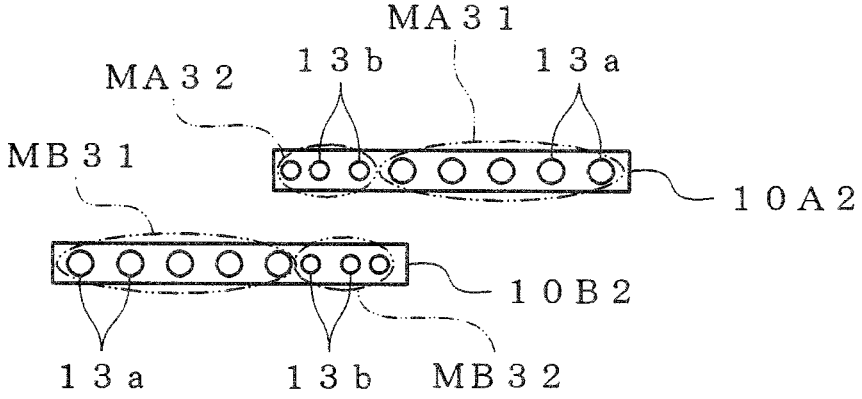
Figure 7A:
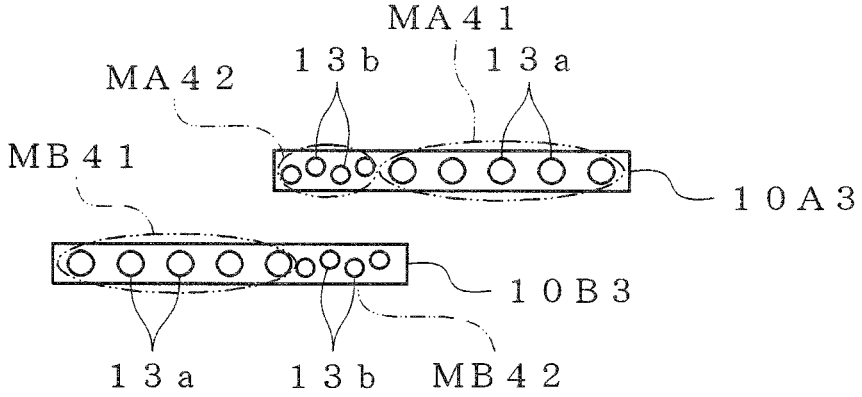

(iii) In the above-described exemplary embodiment, the nozzle pitch is constant in the first direction. However, the nozzle pitch is not necessarily constant. For example, the nozzle pitches of the main nozzle array and the sub nozzle array may be changed. Further, like recording heads 10A2, 10B2 shown in FIG. 6A, the nozzle pitch of the sub nozzles 13*b* may be set to be smaller than that of the main nozzles 13*a* so that the nozzle pitch of the sub nozzles 13*b* becomes smaller toward the end portion in the first direction A. Incidentally, MA31 and MB31 indicate the main nozzle arrays and MA32 and MB32 indicate the sub nozzle arrays. Further, like recording heads 10A3, 10B3 shown in FIG. 7A, the nozzle pitches of the sub nozzles 13*b* may be irregularly set in the first direction A. Incidentally, MA41 and MB41 indicate the main nozzle arrays and MA42 and MB42 indicate the sub nozzle arrays.

Figure 6B:
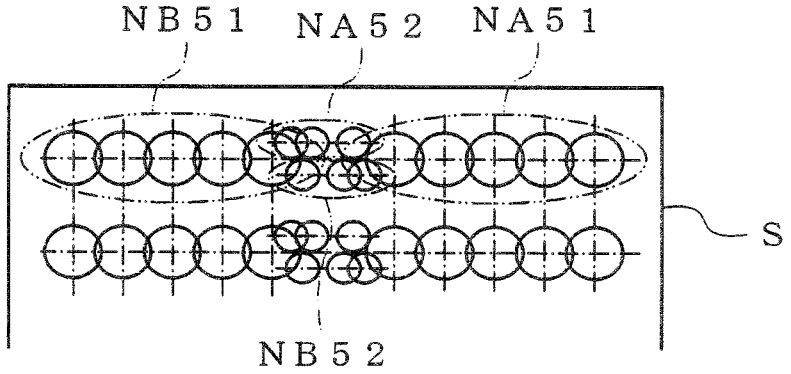
Figure 7B:
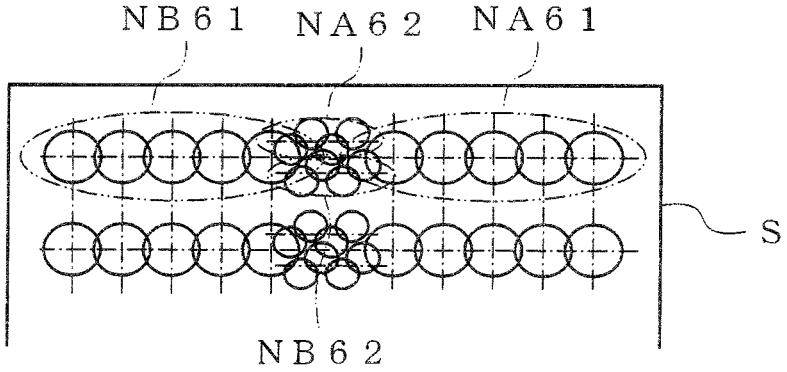

Also in these cases, as shown in FIGS. 6B and 7B, the sub dot arrays NA52, NB52, NA62, NB62 are formed in two arrays with being staggered at a predetermined interval in the second direction B between the main dot arrays NA51, NB51, NA61, NB61, so that it is possible to make the line not be conspicuous. Specifically, by adjusting the amount of liquid droplets to be discharged from the sub nozzles 13*b*, it is possible to finely set the interval over a wide range.

Figure 8:
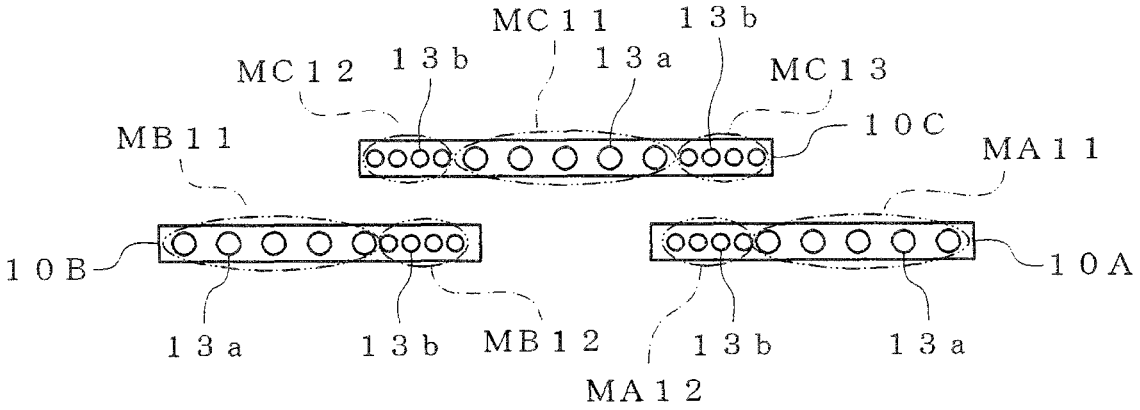
FIG. 8 illustrates still another exemplary embodiment in which three recording heads are provided.

(iv) In the above-described exemplary embodiment, the case where the two recording heads are provided has been described. However, the invention can be also applied to a case where a plurality of recording heads is arranged in a zigzag shape. For example, as shown in FIG. 8, when three recording heads 10A, 10B, 10C are provided, the recording head 10C arranged between the two recording heads 10A, 10B includes a main nozzle array MC11 having a plurality of main nozzles 13*a* arranged at a central part and sub nozzle arrays MC12, MC13 having a plurality of sub nozzles 13*b* arranged at respective end portions of the main nozzle array MC11.

Figure 9:
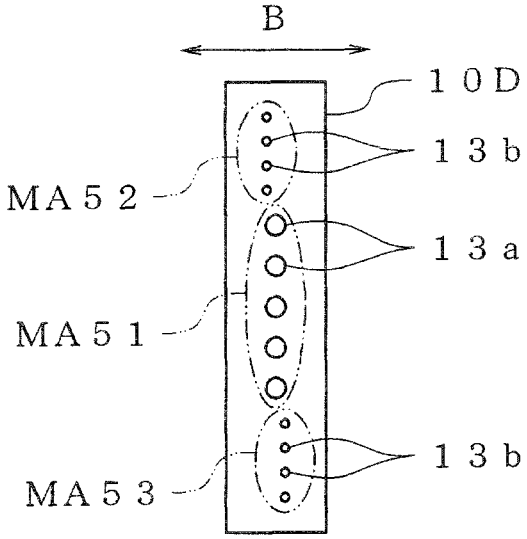
FIG. 9 illustrates a relation of main nozzles and sub-nozzles of a recording head when the invention is applied to a printer having a head unit of a serial type.

(v) In the above-described exemplary embodiment, the invention is applied to the line printer having the head unit of a fixed type including the plurality of liquid droplet discharge heads that is arranged in parallel and whose positions are fixed upon the image recording. In the printer, the liquid droplet discharge heads adjacent to each other are staggered in the second direction B, and the sub nozzles of the liquid droplet discharge heads adjacent to each other are arranged to overlap in the first direction A. The invention is not limited to the head-fixed type. For example, the invention can be also applied to a printer having a head unit of a serial type that discharges liquid droplets of ink toward the recording sheet S while moving in a width direction (e.g., a direction orthogonal to the conveyance direction of the sheet) of the recording sheet S. In this serial type, as shown in FIG. 9, a liquid droplet discharge head 10D includes a main nozzle array MA51 having a plurality of main nozzles 13*a* arranged at a central part and sub nozzle arrays MA52, MA53 having a plurality of sub nozzles 13*b* arranged at both end portions of the main nozzle array. In the second direction B, the sub nozzle arrays MA52, MA53 are preferably arranged with being deviated in the opposed directions from the main nozzle array MA51.

The illustrative and modified embodiments relate to the case where the invention is applied to the printer of an inkjet recording type (one example of the liquid droplet discharge apparatus) discharging the ink to thus form an image and the like on the recording sheet. However, the invention is not limited thereto. For example, the invention can be applied, irrespective of the type and utility of the liquid to be discharged and the technical field. For example, the invention can be also applied to an apparatus that discharges liquid other than the ink, for example coloring liquid to thus manufacture a color filter of a liquid crystal display apparatus, an apparatus that discharges conductive liquid to thus form an electric wiring, and the like.

What is claimed is:

1. A liquid droplet discharge apparatus comprising:

a liquid droplet discharge head comprising a plurality of nozzles arranged in an array along a first direction; and a control unit configured to control the liquid droplet discharge head to discharge liquid droplets from the plurality of nozzles toward a recording medium while moving the recording medium in a second direction orthogonal to the first direction or while moving the liquid droplet discharge head in the second direction, so as to form an image on the recording medium, wherein the plurality of nozzles comprises:

a plurality of main nozzles that is arranged in the first direction and is configured to discharge liquid droplets of main dots having a first diameter; and a plurality of sub nozzles that is arranged at end portion sides of the main nozzles and is configured to discharge liquid droplets of sub dots having a second diameter that is smaller than the first diameter, wherein a center of each of the plurality of sub nozzles is a same as a center of each of the plurality of main nozzles in the second direction, and wherein the control unit is configured to control the liquid droplet discharge head to form a dot array by the liquid droplets discharged from the plurality of main nozzles and the plurality of sub nozzles, the control unit controlling a timing of the discharge of the liquid droplets of the plurality of main nozzles and a timing of the discharge of the liquid droplets of the plurality of sub nozzles to be different from each other, wherein the dots in the dot array formed from the plurality of sub nozzles deviate in the second direction from the dots in the dot array formed from the plurality of main nozzles.

2. The liquid droplet discharge apparatus according to claim 1, wherein the plurality of sub nozzles is configured such that a nozzle pitch thereof in the first direction is irregular.

3. A liquid droplet discharge adjusting method using the liquid droplet discharge apparatus according to claim 1, the method comprising:

comparing shadings of an image formed by dots of liquid droplets discharged from the plurality of main nozzles and an image formed by dots of liquid droplets discharged from the plurality of sub nozzles; and adjusting the timing of the discharge of the liquid droplets of the plurality of sub nozzles to match the shadings.

4. The liquid droplet discharge apparatus according to claim 1, wherein the plurality of sub nozzles is configured such that a nozzle pitch between adjacent sub nozzles in the first direction is smaller than a nozzle pitch between adjacent main nozzles.

5. The liquid droplet discharge apparatus according to claim 1, further comprising:

a second liquid droplet discharge head comprising a second plurality of nozzles arranged in second array along the first direction; and a control unit further configured to control the second liquid droplet discharge head to discharge liquid droplets from the second plurality of nozzles toward a recording medium while relatively moving the recording medium and the second liquid droplet discharge head in the second direction, so as to form an image on the recording medium, wherein the second plurality of nozzles comprises:

a second plurality of main nozzles that is arranged in the first direction and is configured to discharge liquid droplets of main dots having a first diameter; and a second plurality of sub nozzles that is arranged at end portion sides of the main nozzles and is configured to discharge liquid droplets of sub dots having a second diameter that is smaller than the first diameter, wherein a center of each of the second plurality of sub nozzles is a same as a center of each of the second plurality of main nozzles in the second direction, wherein the control unit is configured to control the second liquid droplet discharge head to form a dot array by the liquid droplets discharged from the second plurality of main nozzles and the second plurality of sub nozzles, the control unit controlling a timing of the discharge of the liquid droplets of the second plurality of main nozzles and a timing of the discharge of the liquid droplets of the second plurality of sub nozzles to be different from each other, wherein the dots in the dot array formed from the second plurality of sub nozzles deviate in the second direction from the dots in the dot array formed from the second plurality of main nozzles, wherein the timing of discharge from the plurality of main nozzles, the plurality of sub nozzles, the second plurality of main nozzles and the second plurality of sub nozzles is controlled so that two lines of sub dot arrays are formed between one main dot array, the main dot array being formed by liquid droplets from the plurality of main nozzles and the second plurality of main nozzles, and the two lines of sub dot arrays are formed from liquid droplets from the plurality of sub nozzles and the second plurality of sub nozzles.

6. The liquid droplet discharge apparatus according to claim 5, wherein the liquid droplet discharge head and the second liquid droplet discharge head are arranged in parallel, and the liquid droplet discharge head and the second liquid droplet discharge head are staggered in the second direction and the sub nozzles of the liquid droplet discharge head and the second liquid droplet discharge head are adjacent to each other and are arranged to overlap in the first direction.

7. A liquid droplet discharge apparatus comprising:

a liquid droplet discharge head comprising a plurality of nozzles arranged in an array along a first direction; and a control unit configured to control the liquid droplet discharge head to discharge liquid droplets from the plurality of nozzles toward a recording medium while moving the recording medium in a second direction orthogonal to the first direction or while moving the liquid droplet discharge head in the second direction, so as to form an image on the recording medium, wherein the plurality of nozzles comprises:

a plurality of main nozzles that is arranged in the first direction and is configured to discharge liquid droplets of main dots having a first diameter; and a plurality of sub nozzles that is arranged at end portion sides of the main nozzles and is configured to discharge liquid droplets of sub dots having a second diameter that is smaller than the first diameter, wherein a center of each of the plurality of sub nozzles is offset in the second direction from a center of each of the plurality of main nozzles, and wherein the control unit is configured to control the liquid droplet discharge head to form a dot array by the liquid droplets discharged from the plurality of main nozzles and the plurality of sub nozzles, the control unit controlling a timing of the discharge of the liquid droplets of the plurality of main nozzles and a timing of the discharge of the liquid droplets of the plurality of sub nozzles to be the same, wherein the dots in the dot array formed from the plurality of sub nozzles deviate in the second direction from the dots in the dot array formed from the plurality of main nozzles.

8. The liquid droplet discharge apparatus according to claim 7, wherein the liquid droplet discharge apparatus is a serial printer, and wherein the liquid droplet discharge head is configured such that:

the plurality of sub nozzles are arranged at both ends of the plurality of main nozzles; and the plurality of sub nozzles arranged at both ends of the main nozzles are staggered in opposite directions with respect to the main nozzles.

9. The liquid droplet discharge apparatus according to claim 7, further comprising:

a second liquid droplet discharge head comprising a second plurality of nozzles arranged in second array along the first direction; and a control unit further configured to control the second liquid droplet discharge head to discharge liquid droplets from the second plurality of nozzles toward a recording medium while relatively moving the recording medium and the second liquid droplet discharge head in the second direction, so as to form an image on the recording medium, wherein the second plurality of nozzles comprises:

a second plurality of main nozzles that is arranged in the first direction and is configured to discharge liquid droplets of main dots having a first diameter; and a second plurality of sub nozzles that is arranged at end portion sides of the main nozzles and is configured to discharge liquid droplets of sub dots having a second diameter that is smaller than the first diameter, wherein a center of each of the second plurality of sub nozzles offset in the second direction from a center of each of the second plurality of main nozzles, wherein the control unit is configured to control the second liquid droplet discharge head to form a dot array by the liquid droplets discharged from the second plurality of main nozzles and the second plurality of sub nozzles, the control unit controlling a timing of the discharge of the liquid droplets of the second plurality of main nozzles and a timing of the discharge of the liquid droplets of the second plurality of sub nozzles to be the same, wherein the dots in the dot array formed from the second plurality of sub nozzles deviate in the second direction from the dots in the dot array formed from the second plurality of main nozzles, wherein the timings of discharge from the plurality of main nozzles, the plurality of sub nozzles, the second plurality of main nozzles and the second plurality of sub nozzles is controlled so that two lines of sub dot arrays are formed between one main dot array, the main dot array being formed by liquid droplets from the plurality of main nozzles and the second plurality of main nozzles, and the two lines of sub dot arrays are formed from liquid droplets from the plurality of sub nozzles and the second plurality of sub nozzles.

* * * * *